United States Patent [19]

Dell et al.

[11] 4,289,137

[45] Sep. 15, 1981

[54] SPORTS BRASSIERE

[76] Inventors: Dorothy G. Dell; Christine H. Clifford, both of Rte. 1, Box 560, Waldo, Fla. 32694

[21] Appl. No.: 66,815

[22] Filed: Aug. 15, 1979

[51] Int. Cl.[3] ..... A41C 3/02

[52] U.S. Cl. ..... 128/482; 2/67

[58] Field of Search ..... 128/482, 498, 510; 2/67

[56] References Cited

U.S. PATENT DOCUMENTS

| | | | |
|---|---|---|---|
| 2,018,744 | 10/1935 | Rubino | 2/67 |
| 2,104,867 | 1/1938 | Kemp . | |
| 2,970,597 | 2/1961 | Michel | 128/482 |
| 3,122,143 | 2/1964 | McShea | 128/482 |
| 3,189,028 | 6/1965 | Dormire | 128/155 |
| 3,478,739 | 11/1969 | Librande | 128/132 |
| 3,668,803 | 7/1976 | Hyman | 128/482 |
| 3,908,670 | 9/1975 | Dubin | 128/182 |
| 3,935,865 | 2/1976 | Newmar | 128/488 |

OTHER PUBLICATIONS

Wash Post 4-30-1979 Woodward & Lothrop Adv.
Wash Post 5-6-1979 Hecht Adv.

*Primary Examiner*—Doris L. Troutman
*Attorney, Agent, or Firm*—Kinney, Lange, Braddock, Westman and Fairbairn

[57] ABSTRACT

An athletic or sports brassiere which includes a one-piece back, strong under-bust support, and breast cups which are made to limit upward bounce during jogging or similar athletic activities, but which have elastic panels supporting the underside of the breast. The one-piece back is T-shaped, with the shoulder straps and side bands part of the one piece back. The garment fastens in the front for ease of use and for comfort.

5 Claims, 3 Drawing Figures

SPORTS BRASSIERE

BACKGROUND OF THE INVENTION

1. Field of the Invention

The present invention relates to athletic brassieres which provide for freedom of action and adequate support for women engaged in athletic activities.

2. Prior Art

Various types of brassieres have been constructed in the prior art which are designed to be light and give adequate support to the wearer. Additionally, brassieres have been made which provide for front closure. A lightweight brassiere is shown in U.S. Pat. No. 3,935,865, and includes a pair of cups supported by a narrow body encircling band and having lightweight shoulder straps.

U.S. Pat. No. 3,122,143 shows a front fastening cup arrangement, a strong elastic band encircling the body, but with conventional cup construction.

U.S. Pat. No. 3,908,670 includes exterior front support straps that can be associated with the cups and fastened into place. An additional front closure brassiere is shown in U.S. Pat. No. 2,970,597 (see FIG. 10) and appears to use a Velcro hook and loop fastener. The brassiere is adjustable to alter the position of the cups.

A protective brassiere using a plastic cup is shown in U.S. Pat. No. 3,478,739. Further, the use of Velcro for various fasteners in a surgical chest dressing is shown in U.S. Pat. No. 3,968,803.

U.S. Pat. No. 3,189,028 also shows a type of single band brassiere that is worn around the chest and is used for primarily binding the breasts, but yet providing for adjustability.

It also should be noted that certain swim suits at the present time utilize a one-piece, T-shaped back with a center vertical member and straps coming up over the shoulders, and then including a body encircling portion. However, the entire top portion of the suit is usually made of a single type of material and the suits do not embody the unique support and construction features of the cups of the present brassiere.

Other athletic brassieres have been advanced, and advertised, but generally these include all cotton cups or cups that are lined with cotton, and conventional fastening means. Advertisements for typical devices have appeared in the "Washington Post" of May 6, 1979 for the "running bra" by "Formfit Rodgers". Additionally, the Washington Post for Apr. 30, 1979 included an advertisement for a sports bra by Vassarette.

SUMMARY OF THE INVENTION

The present invention relates to a lightweight athletic or sports brassiere which provides adequate support from a body encircling band and which has cups which limits upward bounce, because the upper parts are made of a fabric which resists easy stretch, and with easily stretch lower cup portions which provide soft support and permit some downward movement of the breasts. The stretchy fabric is sold under the trademark POWERKNIT and is a knitted material made of a combination of 20% Lycra Spandex and 80% nylon.

The upper cup portion may be made of firm Lycra Spandex that resists substantial stretching and therefore limits upward bouncing.

The back of the brassiere is made in one piece with a more-or-less T-shape. The shoulder straps extend from a vertical back member and attach to the upper cup portions at the front of the wearer. The integral side or body bands on the back piece are attached to the cups and toward the front of the wearer. A firm elastic band (made in two sections) extends across the front portion of the chest. This elastic member can be faced with a soft material that rests on the skin.

The brassiere fastener is placed between the cups at the front of the wearer and as shown comprises a vertically elongated hook and loop fastener, sold under the trademark "Velcro". The fastener is narrow in transverse direction and will lay flat against the breast bone of the wearer. The fastener thus can have adequate strength because of its length, but yet lay flat and provide for good support.

The back is made of the POWERKNIT fabric which is soft elastic and gives, and the shoulder straps and other edges of the brassiere are reinforced with a quarter inch strip of elastic on each edge, sewn in place, with a stitch which will stretch, such as a zig-zag stitch.

The garment is very lightweight, easily used, and provides for comfort and control by minimizing seams and by limiting upward movement of the breasts and permitting a soft cushion support underneath, in combination with a firm body contacting underbust elastic band at the front.

DESCRIPTION OF THE PREFERRED EMBODIMENT

The sports brassiere illustrated generally at 10 includes a one-piece T-shaped back and strap assembly 11 which has a center vertical back portion 11A that extends along the center of the back. The upper end of the portion 11A is divided or bifurcated to form two shoulder straps 11B. The straps are made to pass over the top of the shoulder of a wearer.

The lower portion of the back 11 has a pair of side bands 11C which pass forwardly around the sides of the wearer. The side bands can be of any desired vertical height, but generally would be in the range of two inches high, while the shoulder straps are generally about ¾" wide. The forward ends of the side bands 11C taper upwardly as shown at 11D. The lower portion of the side bands 11C are sewed onto underbust front elastic band portions 12A and 12B on opposite sides of the body. The underbust elastic bands are sewed to the under edge of the respective breast cups. The forward edges of the side bands 11D are also sewed to the breast cups.

Each breast cup includes a lower cup portion 13A and 13B, which are sewn to the elastic members 12A and 12B, respectively. The lower cup portions 13A and 13B can be shaped as desired and as shown generally taper upwardly and toward the center and are joined with a suitable flat seam 14A and 14B to upper cup portions 15A and 15B, respectively. The upper cup portions also are shaped as desired and are joined with seams 16A and 16B, respectively, to the respective shoulder straps. The upper cup portions are joined along the side edges to the side bands 11C.

Figure 1:
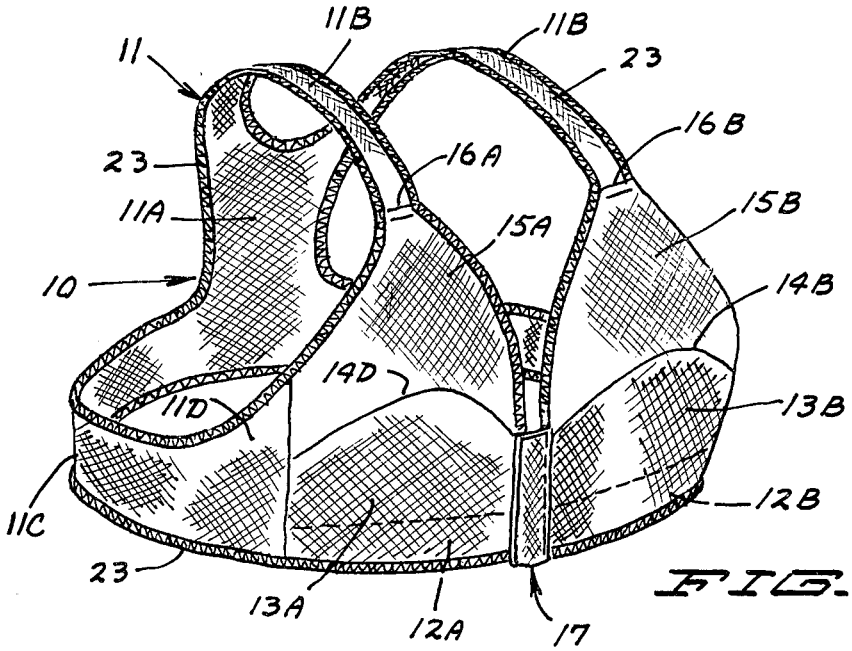
FIG. 1 is a perspective view of the brassiere made according to the present invention.
Figure 2:
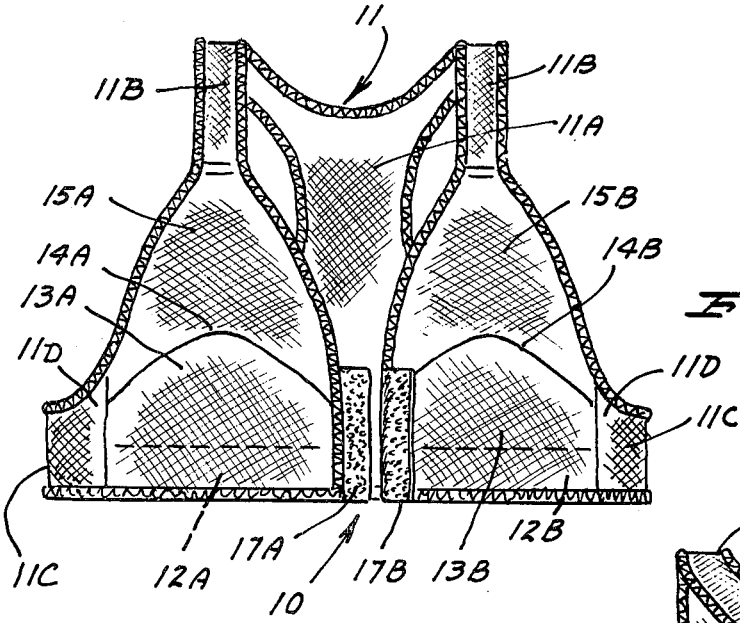
FIG. 2 is a front plan view thereof showing the front fasteners folded open.
Figure 3:
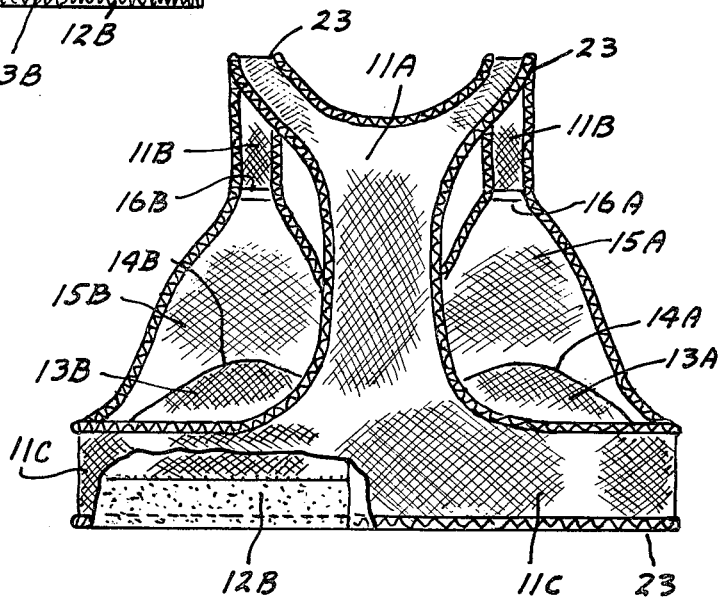
FIG. 3 is a rear view of the brassiere of FIG. 1 with a portion broken away to show the underbust elastic band.

The elastic band portions 12A and 12B and as shown in FIG. 2 the lower cup portions 13A and 13B and the lower, inner edge of upper cups 15A and 15B are joined together with a front hook and loop type fastener assembly indicated generally at 17 made of Velcro brand hook and loop fasteners. The fasteners include a hook fastener indicated at 17A and a loop material portion indicated at 17B. These fastener two portions can be drawn together and pressed into place when the brassiere is put on and the fastener will lay flat inbetween the breasts against the breast bone of the wearer. The elongated fastener length in vertical direction (about two and one-half inches) provides adequate strength, and the transverse width is usually about one-half inch on this type of fabric so that it is not bulky. The inner edges of the cups are also sewn to the edge of the fastener portions.

The vertical seams between the side bands 11C and the cups and underbust elastic bands are near the front of the garment in places where the seams will not tend to interfere with arm movement and where they have little tendency to shift and chafe the wearer.

Additionally, the inner face of the underbust elastic band portions 12A and 12B, can be faced with suitable soft pile or plush material.

The size of the cups, of course, can be varied in the normal fashion and the shape can be varied somewhat, but generally should provide for a close fit. The cup portions 15A and 15B provide substantial resistance to any upward bounce or movement of the breasts during jogging, tennis or sports activities. It has been found to be useful for competition sports, such a hurdles, and also can be used for swimming.

The brassiere can be edged with narrow, about quarter-inch wide elastic strips indicated at 23, if desired, for additional support. The POWERKNIT material is relatively soft, easily stretched knit material, so that the additional elastic along the edges is desired in many instances. The shoulder straps do have "give" so that some downward movement of the straps and the cups is permitted, as well as the yielding downward movement permitted by the undercup fabric.

The design uses as few pieces as possible, without sacrificing the need for restricting upward movement and having soft under support for the breasts, and as well as providing for a firm holding action through the underbust elastic band portions that fasten together in the front. The two portions together form an underbust band when the portions are fastened.

The brassiere is lightweight, easily washed, durable and cool and does not interfere with arm and shoulder movements because of the stretchability of the knitted fabric in all places except the upper cup portion and the underbust elastic. Yet support and shaping is provided without excessive constraint or restriction. The lack of unnecessary seams also eliminates chafing and rubbing.

What is claimd is:

1. A brassiere comprising an underbust band portion, a back member and strap support including side bands attached to said underbust band and passing toward the back of a wearer, shoulder straps for passing up over the shoulders of a wearer, and a pair of bust cups attached to said underbust band and to said straps, said bust cups each comprising two portions including a lower portion and an upper portion, the lower portion of said bust cups being of easily yieldable fabric, and the upper portions of said breast cups being made of a material which resists substantial upward movement of the breast of a wearer under inertial forces caused by sports activities of the wearer, said back member comprising a single substantially vertical band positioned near the center of the back of a wearer, said shoulder straps being attached to and extending from said vertical band, and the side bands also extending from said vertical band.

2. The combination of claim 1 and releasable fastening means between the bust cups to permit separating the bust cups and underbust band.

3. The combination as specified in claim 1 wherein said lower portion of said cups and said back member are made of a material having the properties of a knitted blend of 20% Spandex and 80% nylon.

4. The combination as specified in claim 1 and elastic edging strips attached to the edges of the garment for additional elastic strength.

5. The combination as specified in claim 2 wherein said releasable fastening means is a hook and loop type fastener and is elongated in the vertical direction and narrow in transverse direction so that said fastener will lay against the breast bone of a wearer when fastened.

* * * * *